United States Patent [19]

Tulowiecki

[11] 4,312,474

[45] Jan. 26, 1982

[54] POSITIVE SHUTOFF

[75] Inventor: David Tulowiecki, Liverpool, N.Y.

[73] Assignee: Carrier Corporation, Syracuse, N.Y.

[21] Appl. No.: 165,424

[22] Filed: Jul. 2, 1980

[51] Int. Cl.[3] ..... F24F 7/06

[52] U.S. Cl. ..... 236/49; 165/25; 236/80 R

[58] Field of Search ..... 236/49, 1 B, 80 R; 165/22, 25; 137/82; 251/61.1

[56] References Cited

U.S. PATENT DOCUMENTS

| | | | |
|---|---|---|---|
| 3,143,292 | 8/1964 | Church et al. | 236/49 |
| 3,434,409 | 3/1969 | Fragnito | 98/41 |
| 3,554,111 | 1/1971 | Traver et al. | 98/40 |
| 3,595,475 | 7/1971 | Morton | 236/93 |
| 3,623,542 | 11/1971 | Fragnito et al. | 165/1 |
| 3,867,980 | 2/1975 | Traver | 165/54 |
| 3,961,748 | 6/1976 | McNabney | 236/49 |
| 4,027,171 | 5/1977 | Browder et al. | 236/46 R X |

*Primary Examiner*—William E. Tapolcai, Jr.

*Attorney, Agent, or Firm*—J. Raymond curtin; David J. Zobkiw

[57] ABSTRACT

In a central air conditioning system wherein air flow is regulated by bellows inflation which is controlled by a bleed-type thermostat, simultaneous heating and cooling in a zone is prevented by disabling the bleed-type thermostat when the heating system is activated.

4 Claims, 1 Drawing Figure

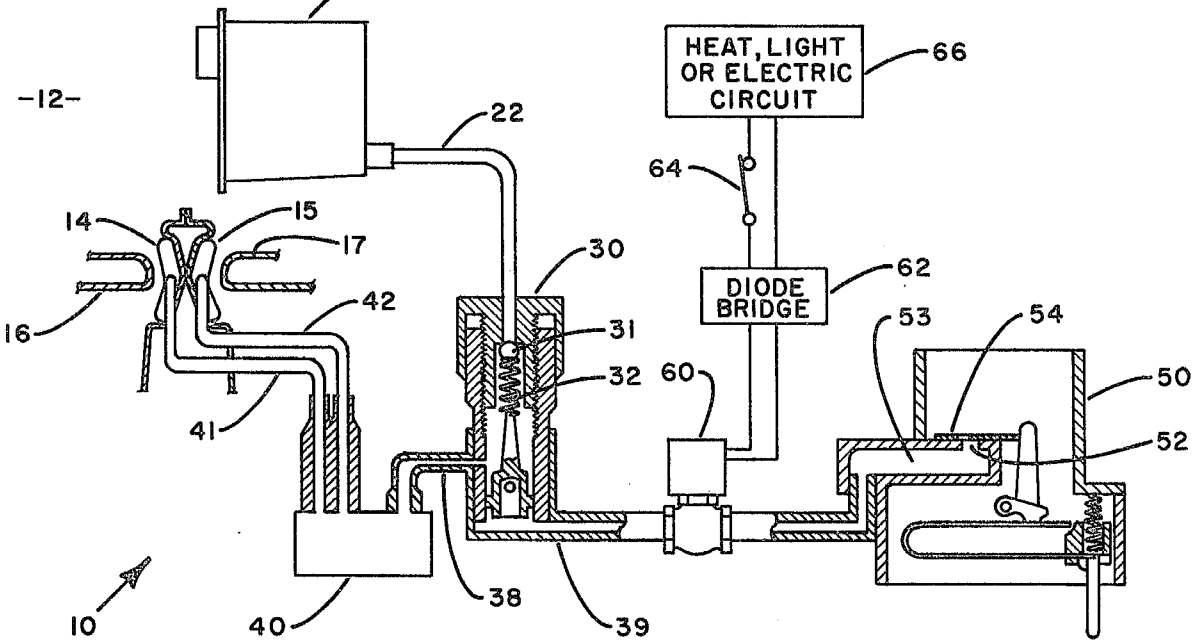
HEAT, LIGHT OR ELECTRIC CIRCUIT
DIODE BRIDGE
66
64
62
60
50
52
54
53
30
31
32
39
38
22
20
42
17
15
14
16
41
40
10

POSITIVE SHUTOFF

BACKGROUND OF THE INVENTION

In large buildings such as multi-story office buildings it is common practice to have a central air conditioning system provide cooled air throughout the building. It is likewise common practice to provide a heating system for the periphery of the building while the core of the building is heated as a by-product of the lighting and equipment as well as the personnel present. In such a situation a cooling demand may occur in the core of the building while the periphery is being heated so that both systems are concurrently in operation and therefore it is necessary that both systems be enabled.

Although current Federal guidelines for heating and cooling temperatures would normally preclude simultaneous heating and cooling in a zone, factors such as sun load may create localized aberations that can cause a cooling demand in a zone that is being heated. This problem is aggravated by the locking of thermostats and having zones that are part in the sun and part shaded. Additionally, because the air conditioning system would respond to the heat from a fire to produce additional ventilation, it is desired, and even required by some building codes, that the air conditioning units be capable of selective disabling in the case of fire. Where rooms and offices are not in use it is likewise desirable that the cooling system be disabled as to the unused areas.

In air distributing arrangements where system pressure is serially passed through a filter and regulator and thence to a bladder and bleed-type thermostat, the bleed-type thermostat controls the inflation of the bladder which coacts with the cutoff plates to control the amount of cooled air entering the room. Normally, such an arrangement would keep the air conditioning system disabled if the heating system were operational and if the Federal guidelines were being observed.

SUMMARY OF THE INVENTION

A normally open solenoid valve is located in the fluid line between the pressure regulator and the bleed-type thermostat. The solenoid is connected to the heating, lighting or electrical system such that when the heating system is activated or the lighting or electrical system deactivated, the solenoid valve is closed thereby disabling the bleed-type thermostat and positively shutting off the air conditioning system in the zone.

It is an object of this invention to prevent the simultaneous heating and cooling of a zone.

It is an additional object of this invention to disable the central air conditioning in selected zones without changing the set points of the thermostats.

It is a further object of this invention to disable selected zones of a central air conditioning system when the selected zones are being heated and/or unoccupied. These objects, and others as will become apparent hereinafter, are met by the present invention.

BRIEF DESCRIPTION OF THE DRAWING

For a fuller understanding of the present invention, reference should now be made to the following detailed description thereof taken in conjunction with the accompanying drawing wherein:

The FIGURE is a schematic representation of a portion of a central air conditioning system employing the present invention.

DESCRIPTION OF THE PREFERRED EMBODIMENT

Referring to the FIGURE, there is illustrated a preferred embodiment of an air distribution unit 10 in accordance with the present invention. Conditioned air is delivered from a central source thereof (not illustrated) to a plenum chamber 12 of the air distribution unit. A damper arrangement illustrated as inflatable bellows 14 and 15 regulate the flow of conditioned air from the plenum 12 to the area or space being conditioned. A portion of the conditioned air furnished to plenum 12 flows to filter 20 where any foreign bodies entrained therein will be removed. The conditioned air passing through filter 20 is used for controlling the operation of unit 10. The control air passes from filter 20 to pressure regulator 30 via line 22. The control air passes from regulator 30 into distributor 40 via line 38 and from distributor 40 via lines 41 and 42 to bellows 14 and 15, respectively. Additionally, control air passes via line 39 to bleed-type thermostat 50 which senses the temperature of the area to be conditioned and in response thereto controls the magnitude of the control signal supplied to bellows 14 and 15 by bleeding control air through bleed port 52.

The damper arrangement employed to control the flow of conditioned air from the plenum 12 further includes aligned cutoff plates 16 and 17 which are provided with a curved surface for coacting with inflatable bellows 14 and 15. By varying the inflation of the bellows, the area between each of the bellows and the cutoff plates may be varied to regulate the quantity of conditioned air discharged into the area or space being conditioned. The manner in which inflation of the bellows is controlled shall be explained in detail hereinafter.

According to the present invention, a normally open solenoid valve 60 is located in line 39 and when valve 60 is open the unit operates under the control of thermostat 50. Normally open solenoid valve 60 is connected to the heating, lighting or electrical system 66 via switch 64. When valve 60 is closed, the thermostat 50 is no longer able to bleed air and thereby control the inflation of bellows 14 and 15 which then inflate fully to close off air flow from the plenum 12 into the zone. As a result, the air conditioning system is positively disabled. Because a solenoid can produce an undesirable hum, a diode bridge 62 is located in the solenoid circuit in order to eliminate the hum.

OPERATION OF THE PREFERRED EMBODIMENT

The operation of the air distribution unit and the control system related thereto shall now be more fully explained.

Assuming that the area to be cooled is at a temperature substantially above the set point, pressurized control air will serially pass through the filter 20 and line 22 to pressure regulator 30 where it will cause ball valve 31 to open against the bias of spring 32. Pressure inside regulator 30 is communicated via line 38 to distributor 40 thence via line 41 to bellows 14 and via line 42 to bellows 15. The bellows 14 and 15 will be inflated to a degree dictated by the pressure in regulator 30 and the degree of inflation of the bellows 14 and 15 will dictate the amount of conditioned air that will be able to pass from the plenum 12 between the bellows 14 and 15 and their respective cutoff plates 16 and 17 into the space to be cooled. The pressure regulator 30 is in fluid communication with chamber 53 of thermostat 50. The pressure in chamber 53 and hence the pressure in regulator 30 and bellows 14 and 15 is controlled by apertured sliding plate 54 which controls the amount of air bled from chamber 53 via bleed port 52. As the temperature in the area to be cooled approaches the set point, flow from chamber 53 via bleed port 52 will be throttled which raises the pressure in chamber 53, regulator 30 and hence bellows 14 and 15 to reduce the flow of conditioned air into the space to be cooled until, when the set point is reached, the bleed flow is stopped and the bellows are fully inflated.

It is obvious that the closing of solenoid valve 60 will produce the same effect as the closing off of the bleed flow by plate 54 of thermostat 50 except that the unit will no longer be responsive to thermostat 50. The closing of solenoid valve 60 can be in response to the actuation of the heating system in the zone, the turning on of the lights in the zone which is equated with occupation of the zone or to the opening of the circuits at the electrical service as in the case of a fire. The normally open state of the solenoid valve can be either due to or in the absence of an electric current. In the case of a separate heating system, for example, the closing of switch 64 can both supply current to solenoid valve 60 to cause its closing as well as to enable the heating system whereby the heating and cooling systems would not be operating in the same zone. Similarly, the closing of switch 64 can both supply electricity to the lights in the zone and to the solenoid valve 60 to cause it to open since the lights would only be turned on if the area was being utilized. Also, the opening of switch 64 can represent the opening of a circuit in the electrical service whereby electric power is cut off from solenoid valve 60 which is thereby closed. Whether the solenoid valve 60 is biased closed and held open when supplied with electric current or biased open and held closed when supplied with electric current is considered to be equivalents since in either case the bleed-type thermostat will be effectively disabled in response to the actuation or deactuation of another system.

Although a preferred embodiment of the present invention has been illustrated and described, other changes will occur to those skilled in the art. It is therefore intended that the present invention is to be limited only by its scope of the appended claims.

I claim:

1. A positive shutoff for an air distribution unit of a central air conditioning system comprising:

bellows controlled damper means for controlling the flow of conditioned air into an area in accordance with the degree of inflation of said bellows;

regulator means for supplying control air to said bellows to cause said bellows to inflate in accordance with the pressure of said control air;

bleed-type thermostatic means operatively connected to said regulator means via a fluid path for controlling the pressure of said control air in response to the setting of said thermostatic means to thereby control the inflation of said bellows by controlling bleeding of said control air;

normally open valve means located in said fluid path intermediate said regulator means and said thermostatic means;

circuit means operatively connected to said valve means for causing said valve means to close in response to a condition existing in said circuit means to thereby prevent said thermostatic means from bleeding said control air whereby said bellows inflates to prevent the flow of conditioned air into an area independent of the setting of said thermostatic means without otherwise disabling the central air conditioning system.

2. The positive shutoff of claim 1 wherein said circuit means is a heating system.

3. The positive shutoff of claim 1 wherein said circuit means is a lighting system.

4. The positive shutoff of claim 1 wherein said circuit means is an electric service.

* * * * *